United States Patent [19]

Smith et al.

[11] 4,090,622

[45] May 23, 1978

[54] ROTARY RETORT FURNACE

[75] Inventors: Jonathan Smith, Glen Ellyn, Ill.; Robert C. Larko; Eugene E. Booth, both of Meadville, Pa.

[73] Assignee: Sunbeam Equipment Corporation, Meadville, Pa.

[21] Appl. No.: 735,728

[22] Filed: Oct. 26, 1976

Related U.S. Application Data

[62] Division of Ser. No. 615,281, Sep. 22, 1975, Pat. No. 4,025,297.

[51] Int. Cl.[2] ..... F23K 3/00

[52] U.S. Cl. ..... 214/18 K; 432/103; 432/56

[58] Field of Search ..... 214/18 K, 21, 2; 432/103, 56; 259/14–16, 30–32; 51/164

[56] References Cited

U.S. PATENT DOCUMENTS

| | | | |
|---|---|---|---|
| 1,518,938 | 12/1924 | Nielsen | 214/18 K |
| 2,031,946 | 2/1936 | Goodell et al. | 214/2 |
| 2,204,145 | 6/1940 | Mueller | 214/18 K |
| 2,772,006 | 11/1956 | Gionet | 214/18.2 |
| 3,357,689 | 12/1967 | Arnesen et al. | 259/14 |
| 3,476,268 | 11/1969 | Munson | 214/18.2 |

*Primary Examiner*—Robert G. Sheridan
*Assistant Examiner*—Lawrence E. Williams
*Attorney, Agent, or Firm*—George R. Clark; Neil M. Rose; Clifford A. Dean

[57] ABSTRACT

A rotary retort furnace wherein the retort is supported for rotation at only one end outside of the heated furnace shell such that the retort is cantilevered into the shell. The rotary retort has a charging door mechanism that cooperates with a skip hoist loading mechanism to provide charges of the parts to be heat treated that are of a uniform size and are introduced into the retort so as to minimize the loss of any controlled atmosphere. The skip hoist loading mechanism has a vibrating feed hopper that dispenses a weight controlled charge into a skip hoist bucket which, after receiving the predetermined charge of parts, is held in a ready position until such time as a cam mechanism controlling the opening and closing of a door on the charge end of the retort causes the door to open and the skip bucket to be moved to a position wherein the parts are dumped into the retort for heat treating. The internal auger flight for the retort is made by forming a number of toroids from a resilient material, radially cutting each of the toroids and deforming them to form individual flights, and connecting one of the split edges resulting from the cutting to the opposite edge of an adjacent flight such that an axially compressed helical subassembly is obtained. The helical subassembly is then screwed onto a shaft having a number of guide pins axially on the shaft at predetermined spacings thereby both axially extending and radially compressing the helical subassembly. The shaft and the helical subassembly are inserted into a retort shell and one free end of the subassembly is welded to one end of the retort. The shaft is then unscrewed from the subassembly while at the same time being forced axially into the retort such that the edges of the helical subassembly fit tightly against the inside of the retort. After the shaft has been removed, the remaining end of the helical subassembly is welded to the end of the retort.

12 Claims, 7 Drawing Figures

20
25
30
35
37
40
41
45
47
50
51
55
56
57
58
60
62
66
68
70
91
96
100
101
115
116
130

100
105
106
108
109

50
100
108
109

ROTARY RETORT FURNACE

This is a division of application Ser. No. 615,281, filed Sept. 22, 1975 now U.S. Pat. No. 4,025,297.

BACKGROUND OF THE INVENTION

Rotary retort furnaces have long been used for the continuous heat treatment of a variety of small parts, such as screws, nuts, bolts, studs, nails and washers. These furnaces, even those without an internal auger flight, are particularly well suited for the processing of such small parts as, in addition to providing continuous operation, the rotary conveying action tends to tumble the parts breaking up any jams or tangled clumps of parts thereby facilitating better and more thorough heat treatment of each of the individual parts. Unfortunately, the cost of manufacturing and maintaining the prior art rotary retort furnaces is not always commensurate with the economy of heat treating such small parts. Furthermore, the manner of loading of the prior art rotary retort furnaces often defeats the advantageous conveying mechanism of the rotary retort in that because of improper and uneven loading, jams of parts are formed at the charge end which cannot be broken up by the continuous tumbling in the rotary retort.

It has long been the practice in the prior art to support a retort for rotation within a heated shell at both ends of the retort or along the entire length of the retort. Such support in the heat treating furnace environment has significant economic disadvantages not only with respect to the original manufacture of it but also in connection with its maintenance. If the retort is supported at both ends outside of the furnace shell to facilitate maintenance then two heat and atmosphere seals will be required. Aside from the initial expense of such duplicate seals, in order to keep the seals effective they must be frequently repaired or replaced. If the support is within the heated shell, it presents serious maintenance problems.

Since rotary retort furnaces are often used in a controlled atmosphere heat treating operation, it is important to minimize any loss of the atmosphere within the furnace. In addition to losses of atmosphere and heat through the seals between the shell and the rotary retort, significant amounts of the atmosphere are lost in prior art furnaces during the charging of the retort.

Manufacture of the internal helical auger flight for a rotarty retort furnace can prove to be an expensive aspect of the cost of construction of such a furnace. Inasmuch as rotary retort furnaces are usually used for handling small parts such as screws and nuts, the outer edges of the auger flight must be kept in close contact with the walls of the retort, otherwise parts will tend to become lodged between the auger flight and the wall. If parts heat treated in one operation become lodged in the spaces between an auger flight and the walls of a retort and subsequently drop into a different set of parts being heat treated in a subsequent operation, it can prove to be a burdensome and expensive task for the heat treater to have to separate such parts. Prior art means of forming an auger contiguous with the walls of the retort, such as machining, casting, or continuous welding of the auger flight edge, are very expensive.

SUMMARY OF THE INVENTION

The present invention involves a rotary retort furnace for small parts wherein the retort is supported for rotation at only one end outside of the shell such that the retort is cantilevered into the shell. A charging door mechanism on the rotary retort cooperates with a parts loading mechanism to provide charges of the parts to be heat treated that are of a uniform size and are introduced into the retort in a manner which minimizes the loss of any controlled atmosphere. The loading mechanism comprises a vibrating feed hopper which dispenses a weight controlled charge into a skip hoist bucket. The skip hoist bucket, after receiving the predetermined charge of parts to be heat treated, is held in a ready position until such time as a cam mechanism controlling the opening and closing of a door on the charge end of the retort causes the door to open and the skip bucket to be moved to a position wherein the parts are dumped into the retort for heat treating.

The retort is provided with an internal auger flight that is made by forming a number of toroids from a resilient material, radially cutting each of the toroids and deforming them to form individual flights, and connecting one of the split edges resulting from the cutting to the opposite edge of an adjacent flight such that an axially compressed helical subassembly is obtained. The helical subassembly is then screwed onto the shaft having a number of guide pins axially on the shaft at predetermined spacings. In screwing the helical subassembly onto the shaft, the subassembly is both axially extended and radially compressed, the helical subassembly and shaft are inserted into a retort shell and one free end of the subassembly is welded to one end of the retort. The shaft is then unscrewed while at the same time being forced axially into the retort such that the edges of the helical subassembly fit tightly against the inside of the retort. After the shaft has been removed, the remaining end of the helical subassembly is welded to the end of the retort.

Accordingly, it is an object of the present invention to provide a rotary retort furnace for small parts wherein the retort is supported for rotation outside of the furnace shell at one end with the free end extending into the furnace shell.

It is a further object of the present invention to provide a rotary retort furnace having an internal auger flight which is economical to assemble yet results in an assembly wherein the edges of the auger flight are in tight contact with the inside wall of the retort.

It is an additional object of the present invention to provide a door means on the charging end of the retort which will seal the charging opening except for the actual times the retort is being charged.

It is yet another object of the present invention to provide loading means for a rotary retort furnace which will automatically supply charges of the parts to be heat treated of a controlled preselected weight.

It is still another object of the present invention to provide control means on the furnace which will coordinate the final dumping of the charge of parts to be heat treated with the opening of the door means on the charging end of the rotary retort furnace.

Further objects and advantages of the present invention will become apparent as the following description proceeds, and the features of novelty which characterize the invention will be particularly pointed out in the claims annexed to and forming a part of the specification.

BRIEF DESCRIPTION OF THE DRAWINGS

For a better understanding of the present invention, reference may be had to the accompanying drawings in which.

DESCRIPTION OF THE PREFERRED EMBODIMENT

Figure 1:
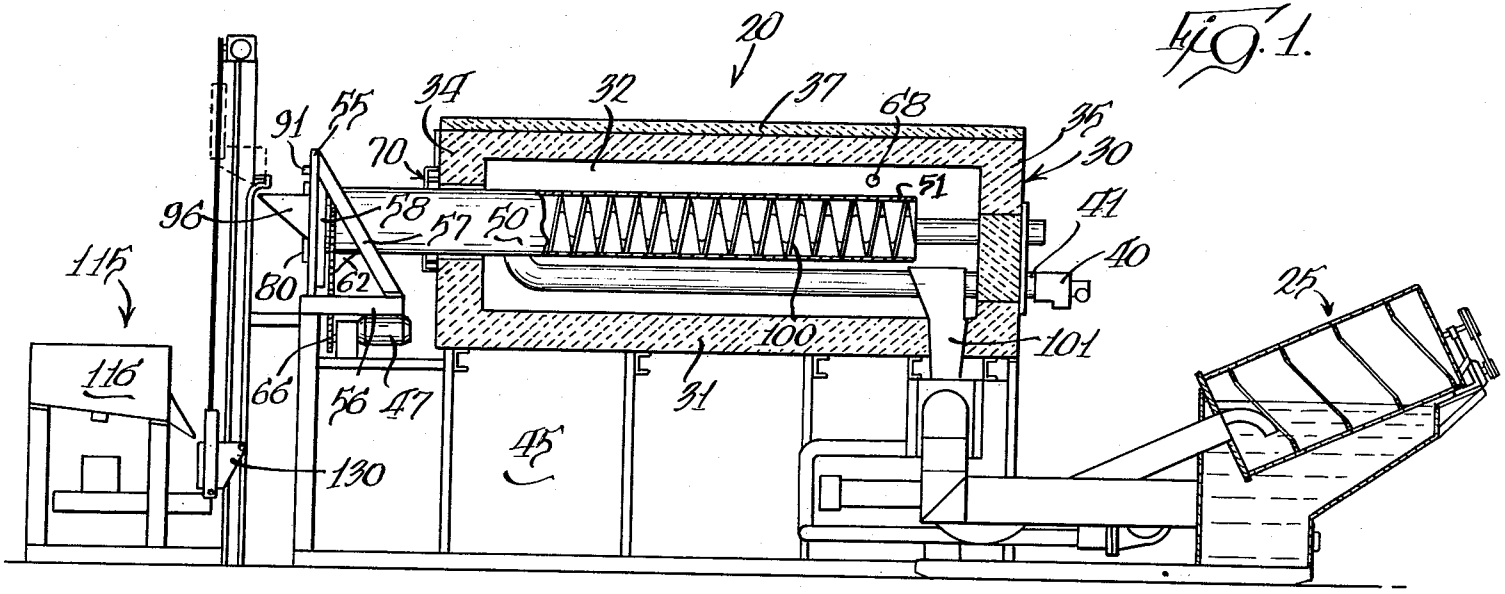
FIG. 1 is a longitudinal view, partly in section, of a rotary retort furnace embodying our invention.

Referring now to the drawings in which like parts are designated by like reference numerals in the various views, there is shown in FIG. 1 a rotary retort furnace generally designated by the reference numeral 20. As indicated in FIG. 1, the rotary retort furnace of the present invention may be used with a liquid quenching system such as that designated by the reference numeral 25 which is disclosed in greater detail in copending application Ser. No. 488,548 filed July 15, 1974, now abandoned, and assigned to the same assignee as the instant application.

The furnace has a heated refractory shell 30 of any conventional design with a floor 31, side walls, one of which is shown in FIG. 1 designated by reference numeral 32, end walls 34 and 35, and a roof 37 which preferably is removable to facilitate access for any necessary maintenance required within the shell. Suitable heating means are provided within the shell. The heating means may either be electric or gas fired, such as the burner 40 with the radiant tube 41 extending through end wall 35.

The shell 30 is supported above the ground by means of a structural metal frame assembly 45. The frame 45 also provides support for the drive mechanism for the rotary retort including the motor 47. Part of the frame assembly also supports the cantilevered retort 50 for rotation. The retort has a cantilevered or free end 51 and a supported end 52. The supported end 52 is mounted for rotation by means of the bearing plate 55 which is supported on the frame assembly 45 or more particularly to the portion of the frame assembly comprising the platform 56 and bracing arm 57. Attached to the bearing plate 55 by welding or other suitable assembly means is an annular water cooled collar 58. Also secured to the plate 55 within the collar 58 is a stationary bearing race 59. Retort 50 has a drive and bearing assembly 60 including flange 62 which is attached to the retort for rotation therewith or may be formed as an integral part of the retort. Drive sprocket 63 is secured to flange 62 as is the rotating bearing race 64. The retort 50 is supported for rotation by the bearing assembly, such as Rotex bearing model number L7-33PIZ Series 2000 with steel spacers of Rotex bearing model number L7-22DIZ Series 2000 with steel spacers, which include the stationary race 59, the rotating race 64 and the ball bearings 65. A drive chain 66 driven by the motor 47 through a gear arrangement (not shown) engages the drive sprocket 63 to rotate the retort 50.

Figure 5:
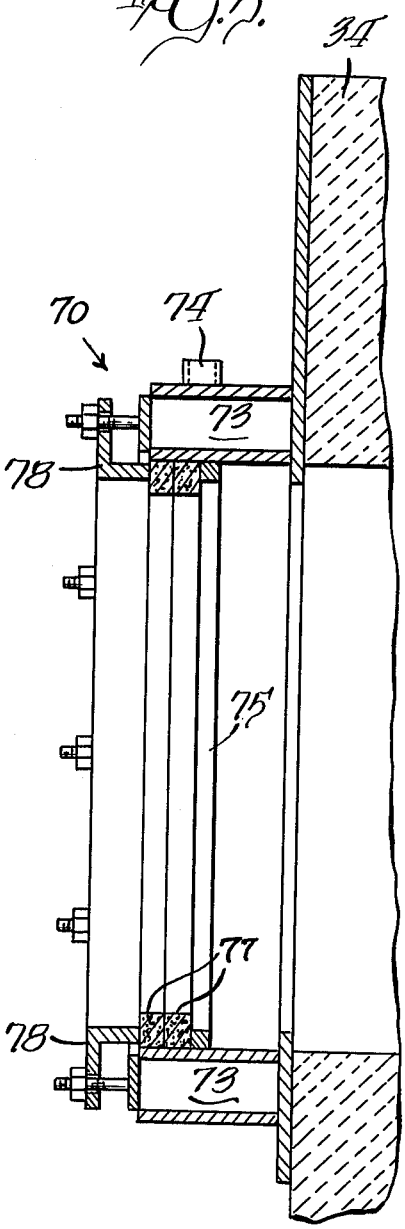
FIG. 5 is an enlarged sectional view of the seal for the retort.

The retort 50 extends through an opening in the end wall 34 of the shell. The free or cantilevered end 51 of the retort is unsupported within the shell and is spaced from the end wall 35. A controlled atmosphere for heat treating is admitted into the shell 30 under pressure by means of inlet 68. A seal assembly 70 which is shown in greater detail in FIG. 5 is provided for the opening in the end wall 34. It includes a plate 71 which is affixed to the outside surface of the end wall 34. The plate carries an annular water cooling jacket 73 having an inlet 74 and an outlet (not shown). Within the area circumscribed by the annular water cooled jacket is a packing flange 75. Between the flange 75 and the outside rim of the water cooled jacket 73 heat resistance packing materials such as asbestos ring seals 77 are secured. The seals 77 are in contact with the rotating retort 50 and prevent the escape of heat and atmosphere from the shell 30. It is preferred to machine a smooth bond on the part of the outside wall of the retort that will be in contact with the ring seals 77 to minimize the wear on the seals. Adjustable clamping means 78 are provided to keep the ring seals 77 compressed as required to maintain them in effective sealing engagement with the retort.

In order to minimize the loss of heat and atmosphere seal at the charging end of the retort itself, the charging end of the retort is generally closed by an end cover plate 80 having a small charging opening 81. The door 83 closes the charging opening except for the period during which products to be heat treated are actually fed into the furnace. The door 83 has a lever arm 85 which is pivotally mounted to the cover plate 80. The arm 85 pivots about the pin 87 which is carried by a bracket member 88 that is attached to the cover plate 80. The end of the arm 85 opposite the end which is secured to the door 83 carries a cam roller 90. A cam 91 is attached to the stationary bearing plate 55. The door 83 is inside the retort 50 and is larger than the charging opening 81. A spring 93 which is secured at one end to the arm 85 and at the other end to a projection 94 attached to the rotating retort biases the door to a closed position. The spring 90 extends through the flange 62, the sprocket 63 and the rotating bearing brace 64. As the retort rotates, the door 83 is biased to its closed position, except for the short interval during which the roller 90 rides upon the cam member 91 to pivot the arm 85 overcoming the biasing force of spring 93 and pushing in the door 83 to open the charging opening 81. As will be discussed in greater detail later in this specification, the opening of the charging door 83 is timed to cooperate with the dumping of a charge of parts to be treated into the charging chute 96.

Parts dumped into the chute 96 for heat-treating are admitted into the rotating retort at the predetermined time determined by the speed of rotation of the retort, the size of the cam roller 93 and the length of the camming surface on cam member 94. The retort is provided with an internal helical auger 100 which conveys the parts to be heat treated through the rotating retort. The parts are discharged at the cantilevered or free end of the retort 51. Disposed below the discharge end of the retort is a quench chute 101 which extends through the floor 31 of the furnace shell into a quenching system 25 such as that described in copending application Ser. No. 488,548, filed July 15, 1974 now abandoned.

Figure 7:
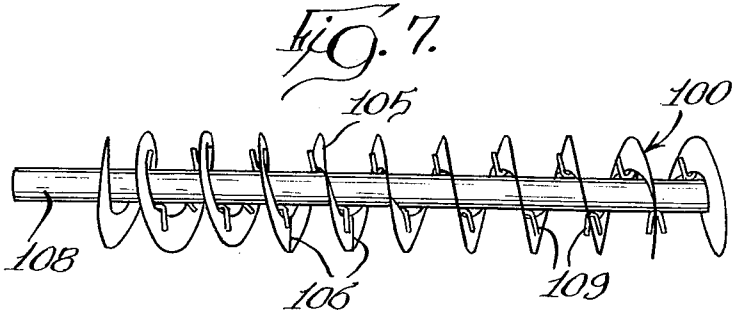
FIG. 7 is a side elevation showing the helical subassembly screwed onto the shaft prior to insertion into the retort.
Figure 6:
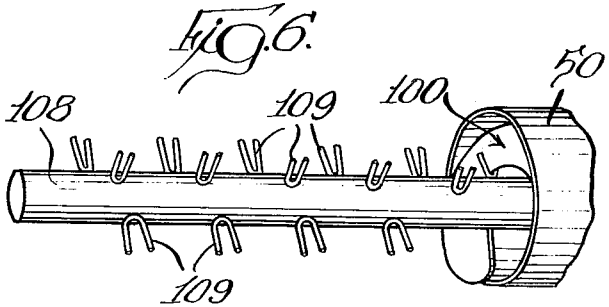
FIG. 6 is a perspective view showing the helical subassembly being inserted into the retort.
Figure 4:
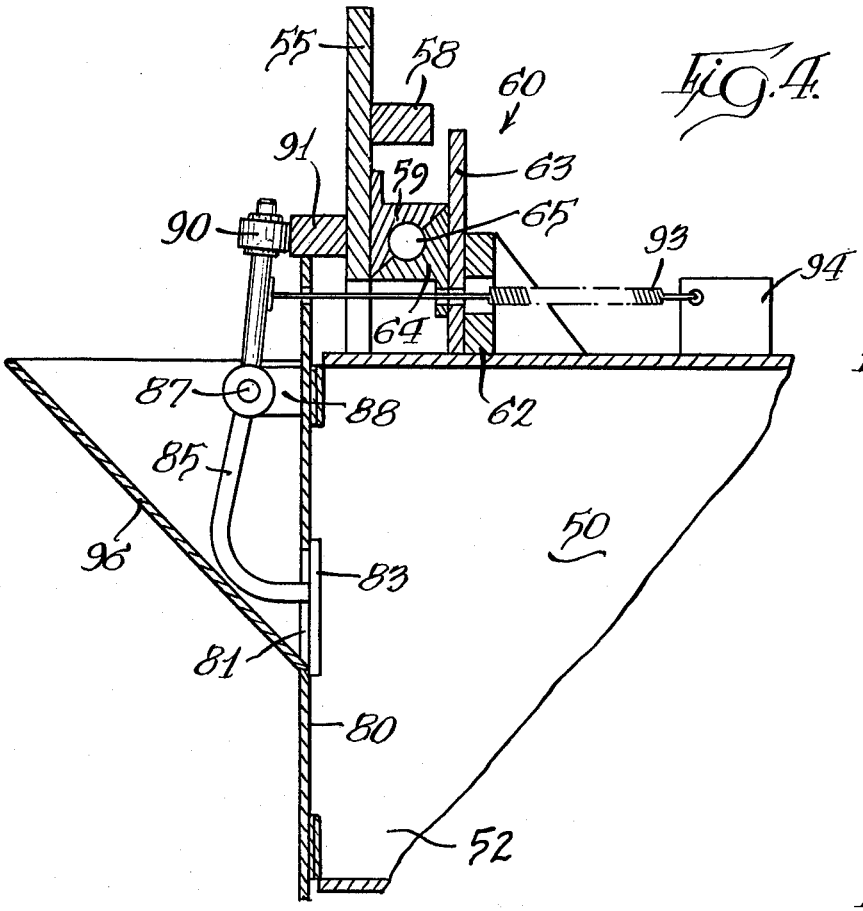
FIG. 4 is an enlarged fragmentary sectional view of the charging end of the retort showing details of the mounting and door mechanisms not included in FIG. 1.

The internal helical auger which extends through the length of the rotating retort 50 is fabricated in a manner which is economical but still insures a tight fit between the outside edges of the auger and the inside wall of the retort. The helical auger 100 is formed from a number of toroids, one of which is designated by reference numeral 105 in FIG. 7. The individual toroids which are of a resilient material are cut radially as is indicated by reference numeral 106 and slightly deformed to form one flight of the helical auger 100. Each flight is then secured to another flight by welding one edge of the radial cut to an opposite edge on another flight. After so joining a number of flights, a compressed helical auger with two free ends is formed. This helical auger subassembly is then axially extended while being compressed in the radial direction by screwing it onto a shaft 108 having a number of guide pins 109. The pins 109 are spaced both radially and axially at predetermined distances such that, when the helical subassembly is screwed onto the shaft, it is longer and has an outside diameter less than the inside of the rotary retort 50. The helical subassembly and the shaft 108 are then inserted into the retort 50, and one free end of the helical subassembly is welded to the adjacent end of the retort. The shaft 108 is then screwed in a reverse direction to remove it from the helical subassembly while, at the same time, the shaft is driven axially into the retort 50 by means of impact blows. The simultaneous forcing of the helical subassembly and the shaft axially into the retort and the removal of the shaft by unscrewing it from the helical subassembly results in the subassembly returning to its former greater diameter to some degree thereby causing the subassembly to fit tightly against the inside walls of the retort 50. A tight fit of the outside edges of the helical subassembly to the inside walls of the retort 50 may be further enhanced by preheating the retort to approximately 200° to 300° F. immediately prior to inserting the helical subassembly. The resulting contraction of the retort 50 as it cools from the elevated temperature will result in a tighter fit.

Figure 2:
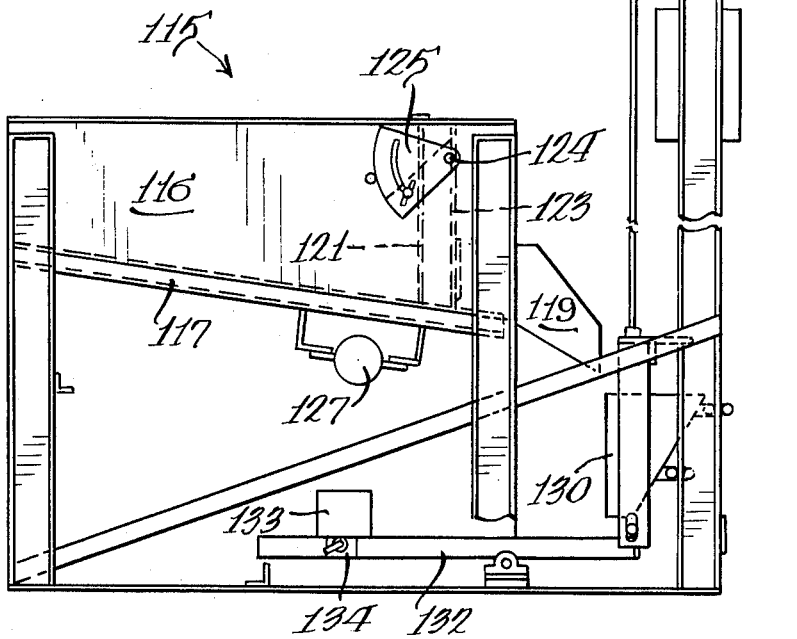
FIG. 2 is an enlarged side elevation of the loading mechanism shown in FIG. 1.
Figure 3:
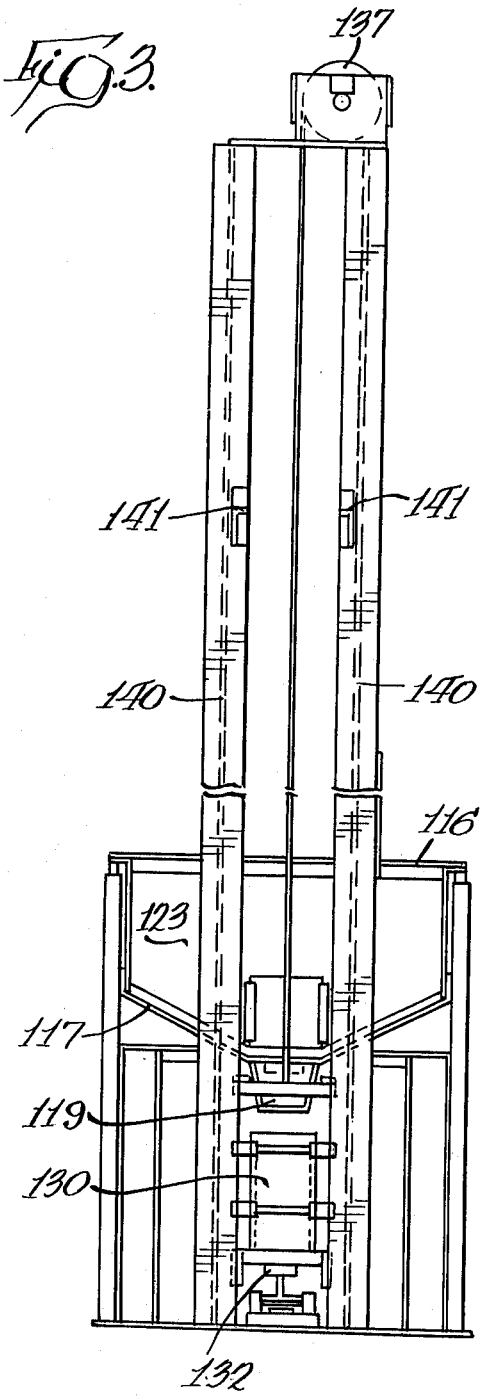
FIG. 3 is an enlarged elevational view of the loading mechanism from the end adjacent the furnace.

Turning now to the parts loading mechanism 115 shown in FIGS. 1, 2 and 3, there is a hopper 116 into which parts to be heat treated are conveyed by any suitable means such as a forklift truck, conveyor belt, or hand loading. The hopper has an inclined floor 117 leading to a chute 119. As is best shown in FIG. 3, the floor 117 also converges downwardly from the sides of the hopper leading to the chute 119. The hopper is provided with at least one vertically positioned pin 121 which serves to break up a load of parts to be heat treated such as screws or the like. Also provided to control the discharge of the parts is pivotally adjustable damper 123 which is secured to horizontal shaft 124. The sides of the hopper rotatably support horizontal shaft 124 thereby permitting the damper 123 to be pivoted about the axis of the shaft 124. The damper may be locked in any particular angular orientation with respect to the floor 117 by means of the control member 125 or by a turnbuckle secured between the damper 123 and a stationary member.

The incline of floor 117 of the hopper is slight, approximately 7½°, such that most parts of the type which will be handled by the rotary retort furnace will not, particularly with the control damper 123, feed through the chute 119 soley by force of gravity. To control the feeding of the parts from the hopper, a vibrator 127 is attached to the inclined floor 117. Parts emerging from the chute 119 drop into a skip hoist bucket 130 which dumps the parts into the retort charging chute 96. It has been founded desirable to control the size of each charge of parts by weight in order to permit proper spacing of the parts within the rotary retort as they are being conveyed through the retort during heat treating. The weight of the charge is controlled by the operation of the vibrator 127. When the skip hoist bucket 130 reaches its lowermost position, it trips a switch (not shown) which completes an electrical circuit activating the vibrator 127.

Upon receiving the preselected weight of parts, the skip hoist bucket 130 tips the balance beam 132 which has been set by positioning the counterweight 133. The counterweight 133 is slidable along the balance beam and may be locked into position by the locking mechanism 134. Alternatively, a series of weights may be used to set the balance beam 132. Tipping of the balance beam by the skip hoist bucket actuates another switch (not shown) which interrupts the circuit and shuts off the vibrator 127. After the vibrator is shut off, a skip hoist motor 136 is automatically energized. It has been found to be preferable to have a time delay in the magnitude of two seconds for allowing the vibrator to stop before starting the skip hoist motor 136. The skip hoist motor, in turn, drives the winch 137 which moves the bucket 130 up the guide rails 140. Ascent of the skip hoist bucket is momentarily halted just before it reaches the outwardly turned ends of the guide rails at 141 which would cause the bucket to dump the parts into the charging chute 96. This momentary halting of the ascent is accomplished by the bucket tripping a delay switch (not shown) on the guide rails just prior to the bucket reaching the portion of the rails designated by reference numeral 141.

Coordinated with the previously discussed charging door 83 opening mechanism is another switch (not shown) which reactivates the skip hoist motor 136 for dumping the parts into the charging chute 96 at the time that the door 83 is opened. After dumping the parts, the skip hoist bucket descends to its lowermost point again tripping the switch which actuates the vibrator.

While the specific embodiments of the present invention have been shown and described, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by Letters Patent of the United States is:

1. A rotary report furnace comprising an outer shell, a rotating retort extending into said shell, said retort having a charge end and a discharge end, said charge end having a closable opening for receiving parts to be heat treated, closure means for said opening including door means normally biased to a closed position, cam means to urge said door means open at a preselected point in time in the operation of said retort for a preselected length of time, loading means for deliverng parts to be heat treated to said charge end, and control means for synchronizing the delivery of said parts by said loading means with said opening of said door.

2. Loading means for a rotary retort furnace comprising hopper means for holding parts to be heat treated in said furnace, delivery means for conveying parts from said hopper means to said furnace, electrically operated means for moving said parts from said hopper means into said delivery means, said delivery means being movable vertically between a parts receiving position and an elevated parts dumping position, first control means for activating said electrically operated means upon said delivery means moving downwardly into said parts receiving position, second control means for deactivating said electrically operated means upon said delivery means receiving a charge of a preselected weight and activating means for driving said delivery means upwardly from said parts receiving position to said parts dumping position.

3. A loading means for a rotary retort furnace as defined in claim 2 including additional control means effecting a momentary delay of said delivery means from reaching said parts dumping position and dump control means which reactivate said delivery means to synchronize the dumping of said charge with a predetermined condition of said furnace.

4. A rotary retort furnace comprising an outer shell, a rotating retort extending into said shell, said retort having a charge end and a discharge end, said charge end having a closable opening for receiving parts to be heat treated, closure means for said opening including door means normally biased to a closed position, cam means for urging said door means open at a preselected point in time in the operation of said retort for a preselected length of time, loading means including hopper means for holding parts to be heat treated in said furnace, delivery means for conveying parts from said hopper means to said furnace, means for supplying said delivery means with a charge of parts of a preselected weight from said hopper means, electrically operated means for moving said parts from said hopper means into said delivery means, said delivery means being movable between a parts receiving and a parts dumping position, and control means for synchronizing movement of said delivery means into said parts dumping position with said cam means urging said door means open.

5. Apparatus for loading parts into a furnace having an elevated inlet opening comprising a hopper for holding parts to be heat treated and being disposed below said inlet opening, delivery means being mounted for movement in a vertical direction from a parts loading position adjacent said hopper to a parts dumping position adjacent said inlet opening, electrically operated means for moving parts from said hopper into said delivery means, said electrically operated means being energized to move parts when said delivery means is in said parts loading position, motor means to drive said delivery means between said positions, means responsive to the weight of said delivery means to deenergize said electrically operated means and to energize said motor means to drive said delivery means upwardly to said parts dumping position.

6. The apparatus of claim 5 wherein said means responsive to the weight of said delivery means deenergizes said electrically operated means when a preselected weight of parts has been moved into said delivery means, means providing a time delay between deenergization of said electrically operated means and energization of said motor means.

7. The apparatus of claim 6 wherein said hopper has an inclined bottom wall to provide gravity dispensing of said parts between said hopper and said delivery means, said electrically operated means including a vibrator mounted to mechanically vibrate said hopper to cause said parts to move from said hopper to said delivery means.

8. The apparatus of claim 5 wherein said motor means is provided with control means for arresting the upward movement of said delivery means prior to its reaching the parts dumping position, said furnace having closure means for said inlet opening which is periodically opened at regular intervals, said control means for said motor means being actuated by said closure means to reactivate said motor means to move said delivery means into said parts dumping position causing said parts to be dumped when said inlet opening is unobstructed by said closure means.

9. A combined furnace and loading mechanism comprising a rotary retort furnace having an elevated retort supported for rotation about its axis, closure means at one end of said retort including means defining an opening through which parts move into said furnace and a door movable between obstructing and nonobstructing positions with respect to said opening, a chute supported on said retort and positioned to direct parts through said opening, cam means connected to open said door periodically on each rotation of said retort, delivery means for automatically raising said parts from a loading position to the level of said opening, means for automatically dispensing said parts into said chute when said door is in its nonobstructing position.

10. The combination of claim 9 wherein said delivery means comprises a skip hoist having a pivotally mounted bucket which is propelled along vertically extending guide rails by motor means, means mounted along the path of said bucket to pivot said bucket and dump said parts into said chute, control means for synchronizing the upward movement of said bucket into an unloading position for dumping parts into said furnace with the periodic opening of said door.

11. The combination of claim 10 wherein said delivery means includes means for automatically energizing said motor means to propel upwardly said bucket from said loading position to a position below said unloading position, means for reactivating said motor means to move said bucket into said unloading position to dump said parts when said door is open.

12. The combination of claim 9 wherein said delivery means is automatically raised in response to a predetermined weight of parts being dispensed into said delivery means at said loading position.

* * * * *